United States Patent [19]

Laursen, Jr.

[11] Patent Number: 4,534,559

[45] Date of Patent: Aug. 13, 1985

[54] . GAME PLAYING APPARATUS

[75] Inventor: Donald Laursen, Jr., Fremont, Calif.

[73] Assignee: Edmund Arthur Thrum, Fremont, Calif.

[21] Appl. No.: 433,469

[22] Filed: Oct. 12, 1982

[51] Int. Cl.[3] ..... A63F 7/04

[52] U.S. Cl. ..... 273/113

[58] Field of Search ..... 273/109, 113, 144 A, 273/147, 1 GG, 1 GE, 1 G, 116

[56] References Cited

U.S. PATENT DOCUMENTS

| | | | |
|---|---|---|---|
| 2,665,915 | 1/1954 | Steig | 273/109 X |
| 2,902,284 | 9/1959 | Massaro | 273/144 A |
| 3,008,719 | 11/1961 | Misko | 273/113 X |
| 3,565,440 | 2/1971 | Glass et al. | 273/1 GG |
| 3,591,175 | 7/1971 | Glass et al. | 273/1 G |
| 3,617,058 | 11/1971 | Goldfarb | 273/1 GG |
| 4,027,877 | 6/1977 | Breslow et al. | 273/1 G |
| 4,215,858 | 8/1980 | Olsen | 273/1 GG |
| 4,402,512 | 9/1983 | Joseph | 273/273 |

*Primary Examiner*—Richard C. Pinkham
*Assistant Examiner*—Scott L. Brown
*Attorney, Agent, or Firm*—Fitch, Even, Tabin & Flannery

[57] ABSTRACT

A game is played by placing a plurality of first playing pieces, a plurality of second playing pieces and a third playing piece in an opaque container. The container has an opening which allows the playing pieces to sequentially pass through when shaken. Dice, or other means, are rolled to obtain an indicia number. The container is shaken until the number of first playing pieces is removed in accordance with the indicia number. However, should any of the second playing pieces also be removed from the container before the indicia number is reached, the player loses. If the third playing piece is removed from the container during the play the effect of a subsequent second playing piece also being removed has no effect.

5 Claims, 7 Drawing Figures

FIGURE 5
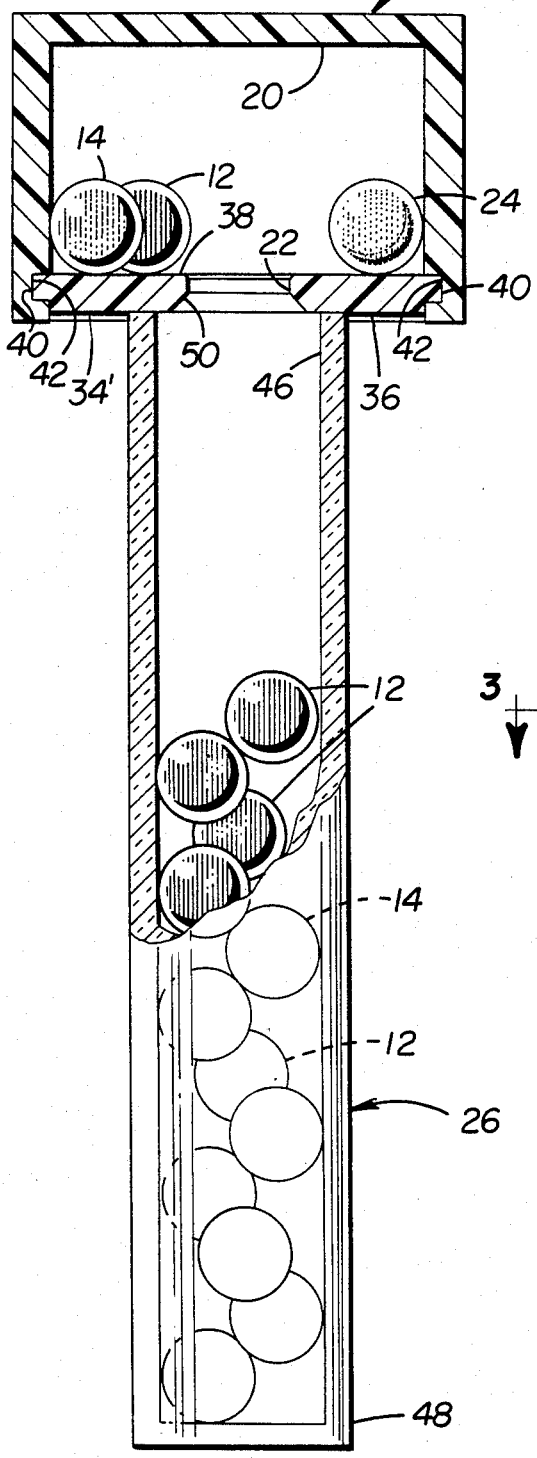
FIGURE 3
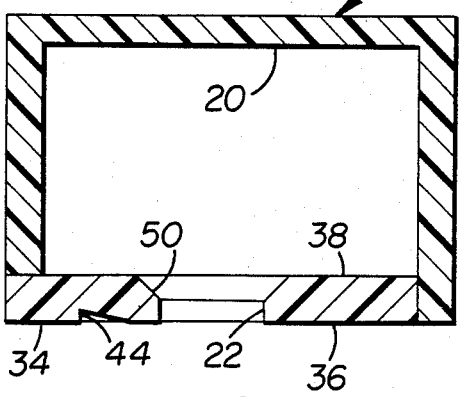
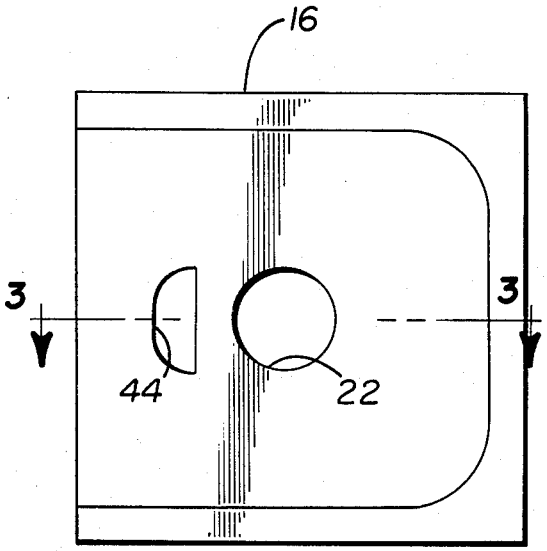
FIGURE 2
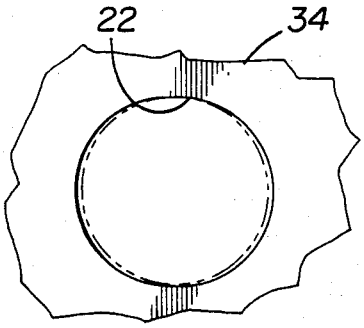
FIGURE 4

FIGURE 7
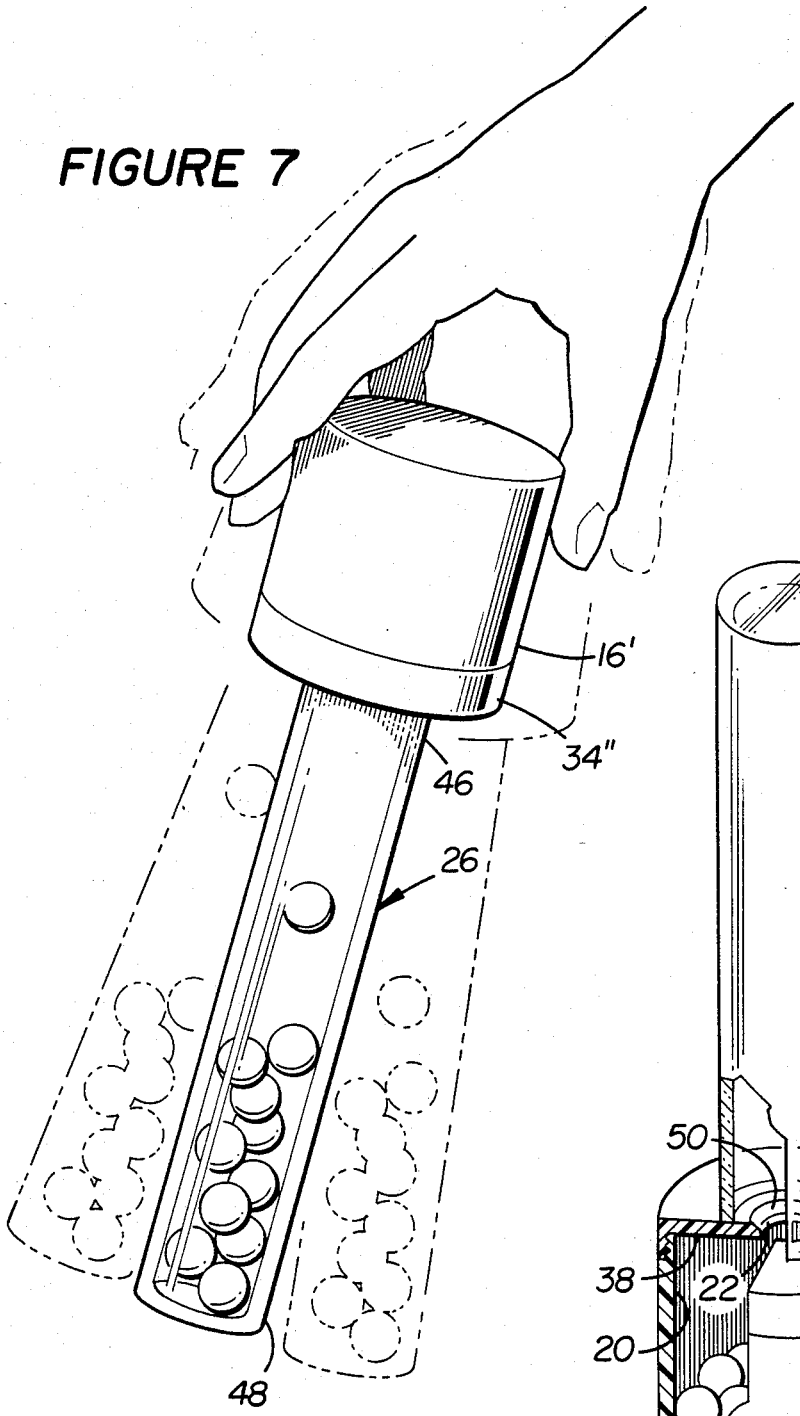
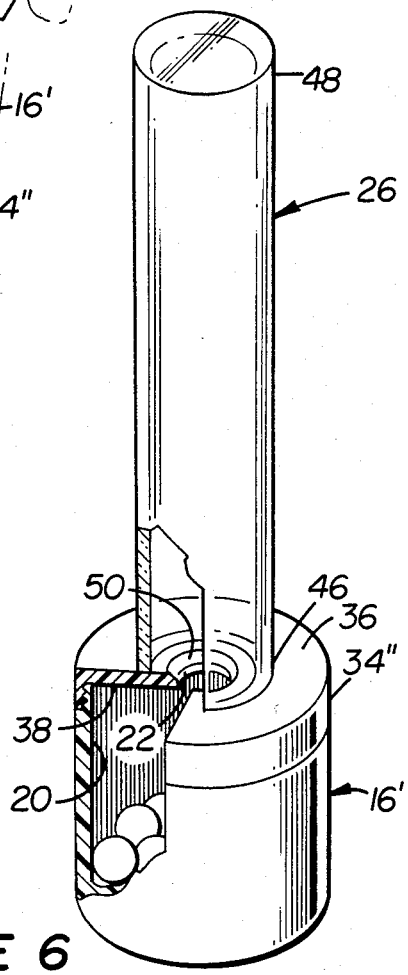
FIGURE 6

GAME PLAYING APPARATUS

The present invention relates generally to a competitive game of chance.

An object of the present invention is to provide a game of chance that is enjoyable by players of all skills and age levels.

According to the present invention, a game includes a plurality of first playing pieces and a plurality of second playing pieces. The game further includes a container having an interior cavity for containing the playing pieces and an opening communicating the cavity exteriorly of the container. The opening is dimensioned to allow the playing pieces to randomly and sequentially pass therethrough when the container is manually manipulated. The game is scored by causing the playing pieces to be removed from the container in accordance with a randomly preselected indicia.

FIG. 2 is a plan view of some assembled components shown in FIG. 1 in one embodiment of the present invention.

FIG. 3 is a cross-sectional view taken along line 3—3 of FIG. 2.

FIG. 4 is an enlargement of a detail of FIG. 2.

FIG. 5 is an elevational view, partially broken and partially in cross-section, of some assembled components shown in FIG. 1 in another embodiment of the present invention.

FIG. 6 is an elevational view, partially broken and partially in cross-section, of yet another embodiment of a gaming apparatus according to the principles of the present invention.

FIG. 7 illustrates a method of use of the embodiment of the gaming apparatus shown in FIG. 6.

Figure 1:
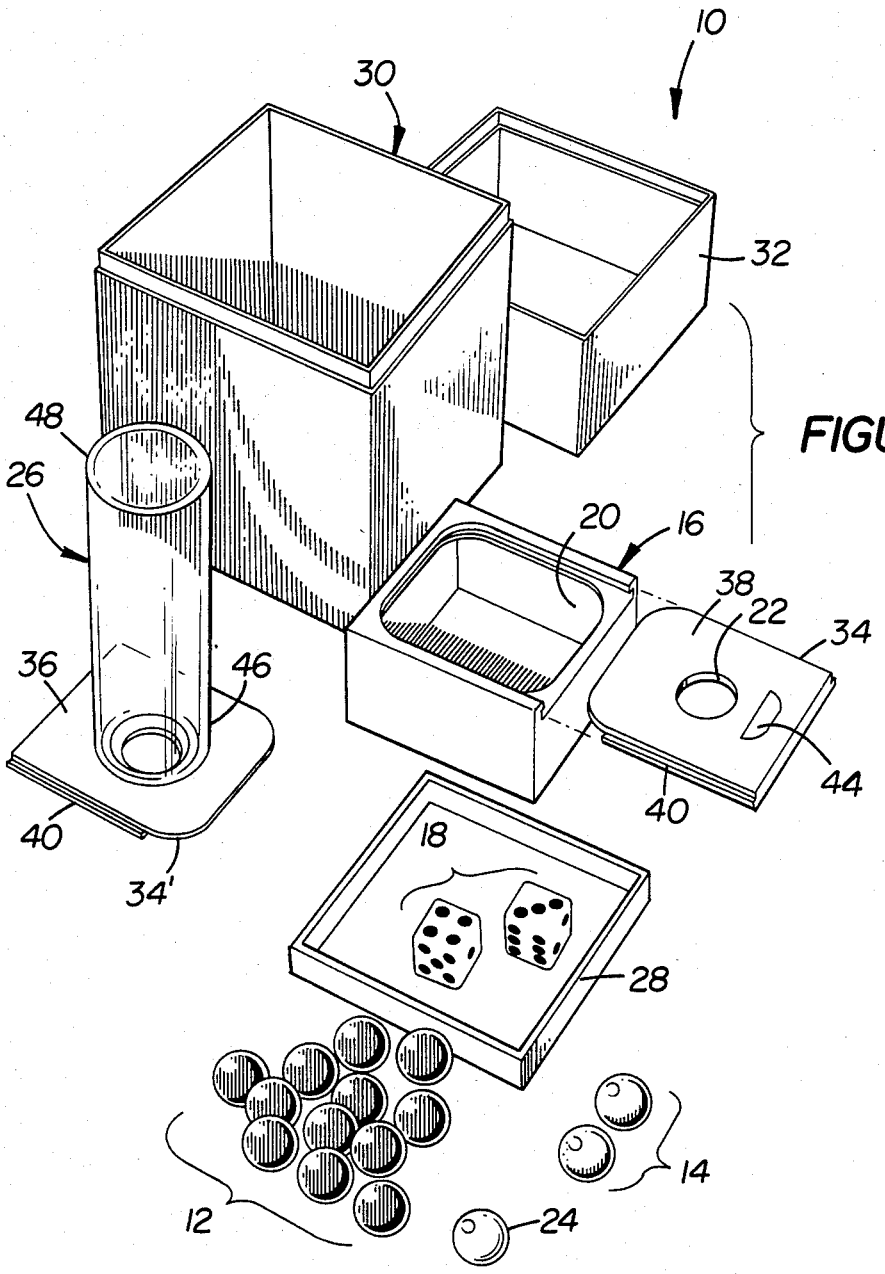
FIG. 1 is a perspective view of various components of several embodiments of a gaming apparatus according to the principles of the present invention.

Referring now to FIGS. 1–5, there is shown various components of several embodiments of a game 10. One embodiment of game 10 includes a plurality of first playing pieces 12 visually similar to each other, a plurality of second playing pieces 14 visually distinct from first playing pieces 12 and visually similar to each other, an opaque container 16, and indicia means 18 for randomly selecting an indicia.

Container 16 has an interior cavity 20, and an opening 22 communicating cavity 20 exteriorly of container 16. Cavity 20 is dimensioned for loosely containing all of first pieces 12 and second playing pieces 14 when playing game 10 as hereinbelow described. Opening 22 is dimensioned commensurately with each of first and second playing pieces 12 and 14, for allowing sequential passage of first and second playing pieces 12 and 14 therethrough when playing game 10. Game 10 is played by removal of first and second playing pieces 12 and 14 in accordance with indicia means 18.

Other components useful in other embodiments of game 10, whether as alternatives or modifications of components hereinabove described, include a third playing piece 24, a hollow, translucent tubular member 26, a tray and carrying case 30 having a removable top portion 32 for carrying and conveniently storing all hereinabove described components.

Container 16 may include a removably mounted wall portion 34 or 34'. Wall portion 34 as shown in FIG. 1 is in an inverted and rotated position for clarity of detail. Wall portion 34 or 34' has an outside face 36, an inside face 38 and longitudinal ribs 40. Although not necessary in practicing the present invention but useful when loading first, second and third playing pieces 12, 14 and 24 into container 16, wall portion 34 or 34' may also include opening to prevent such playing pieces 12, 14 and 24 accidentally escaping through opening 22.

Container 16 may include channels 42 dimensioned for slidably receiving ribs 40 to removably mount wall portion 34 or 34' thereto. To faciliate removal of wall portion 34 from container 16, wall portion 34 may further have a depression 44 on outer face 36. Depression 44 is useful for engaging a finger nail.

Tubular member 26 has an open end portion 46 and a closed end portion 48. Tubular member 26 is perpendicularly attached at open end portion 46 to outer face 36 of wall portion 34 or 34'. The inside of tubular member 26 is in communication with interior cavity 20 through opening 22.

With particular reference to FIGS. 3–5, opening 22 includes a beveled counterbore 50. Counterbore 50 may be disposed either at inside face 38, as shown in FIG. 3 on wall portion 34, or an outside face 36, as shown in FIG. 5 on wall portion 34'.

In one embodiment of the present invention, when first, second and third playing pieces 12, 14 and 24 are spheres such as marbles, counterbore 50 allows such spheres to pass readily through opening 22 from the side of wall portion 34 or 34' which has counterbore 50. Opening 22 may also have radius dimensioned slightly larger than the radius of such spheres.

As seen in FIG. 4, opening 22 may also be slightly elliptical. Spheres entering opening 22 along its larger dimension will pass therethrough more readily especially if the shorter dimension of opening 22 is substantially equal to the radius of the spheres. Opening 22 when elliptical is useful for increasing the randomness of spheres passing therethrough.

As the game is played as hereinbelow described, first, second and third playing 12, 14 and 24 may be collected on a table or in a hand. Tray 28 is one useful component to collect first, second and third playing pieces 12, 14 and 24. When first, second and third playing pieces 12, 14 and 24 are spheres, tubular member 26 is a particularly useful component to collect the spheres preventing the spheres rolling around and preserving the order with which spheres have been removed from container 16 as illustrated in FIG. 5 by the exemplary location of second playing pieces 14 and third playing pieces 24, all other being first playing pieces 12.

Referring now to FIG. 6, a further embodiment of game 10 is shown. Similar reference numerals of FIG. 6 and FIGS. 1–5 describe similar components with differences explained hereinbelow. Container 16' and wall portion 34'' are cylindrical and threadedly engaged to each other.

The method of playing game 10 is explained with reference to FIG. 7 which shows the embodiment of game 10 of FIG. 6. However, the description hereinbelow makes reference to all modifications and alternative as shown in FIGS. 1–5.

All of first and second playing pieces 12 and 14 are placed in interior cavity 20 of container 16 or 16'. Wall portion 34, 34' or 34'' is engaged to container 16 or 16'. Indicia means 18, such as dice, are rolled to randomly indicate any number not exceeding the number of first playing pieces 12. Although the use of dice limits first playing pieces 12 to a number of 12, any number of first playing pieces 12 could be accommodated by providing a numbered circle and a spinnable pointer radially mounted thereto in another embodiment of indicia means 18.

Container 16 is then shaken as illustrated in FIG. 7 so that first playing pieces 12 pass through opening 22. When the number of first playing pieces 12 passing through opening 22 equals the number given by indicia means 18 prior to any of second playing pieces 14 passing therethrough, the player wins. Any second playing pieces 14 passing through opening 22 before the number of first playing pieces 12 equal the indicia number causes the player to lose.

Another embodiment of the present invention utilizes third playing piece 24. Third playing piece 24 is placed in interior cavity 20 with all of first and second playing pieces 12 and 14 at the start of the game. An indicia number is randomly selected by use of indicia means 18. As the player tries to shake out the number of first playing pieces 12 in accordance with the indicia number, should third playing piece 24 also come out, hereinabove described effect of a subsequent one (or all) of second playing piece 14 passing through opening 22 has no effect.

In one embodiment of the present invention, first playing pieces 12, second playing pieces 14 and third playing piece 24 are marbles of a common radius and of a first, second and third color, respectively.

The present invention has been described herein with reference to a preferred embodiments thereof. It is now obvious to those skilled in the art to make numerous uses and modifications to the preferred embodiments of the present invention without departing from the inventive concepts disclosed herein. The present invention is defined and limited only by the spirit and scope of the appended claims which hereinafter follow.

What is claimed is:

1. A game comprising:

a plurality of first spherical playing pieces, each of said first spherical playing pieces being visually similar to each other;

a plurality of second shperical playing pieces visually distinct from said first spherical playing pieces, each of said second spherical playing pieces being visually similar to each other;

a third spherical playing piece visually distinct from each of said first spherical playing pieces and each of said second spherical playing pieces;

a container having an interior cavity and an opening communicating with said cavity exteriorily of said container, said cavity being dimensioned for loosely containing all of said first spherical playing pieces, said second spherical playing pieces and said third spherical playing pieces, said opening being dimensioned for allowing said spherical playing pieces to pass sequentially therethrough upon manual manipulation of said container, said opening being elliptical to increase the randomness in the order of said first, second and third spherical playing pieces passing therethrough; and indicia means for randomly selecting an indicia, said first spherical playing pieces being for removal from container through said opening commensurately with said indicia upon manual manipulation of the container prior to any one of said second playing pieces passing through said opening, said third playing piece when passing through said opening nullifying the effect of at least a subsequent one of said second playing pieces passing through said opening.

2. A game in accordance with claim 1 wherein all of said first, second and third spherical playing pieces are all of the same radius, said first spherical playing pieces, said second spherical playing pieces and said third spherical playing piece having a first, second and third color, respectively.

3. A game in accordance with claim 1 wherein said indicia means includes dice, said indicia being a number given on the top face of said dice after being rolled.

4. A game in accordance with claim 3 wherein a number of said first playing pieces equal to said indicia number is to be shaken from said container prior to any of said second playing pieces being shaken therefrom.

5. A game in accordance with claim 1 further including a hollow, tubular member having an open end and a closed end, said member being mounted to said container with said open end in communication with said opening of said container whereby the inside of said member communicates with said interior cavity, said member having an inside diameter dimensioned for receiving said playing pieces in a sequential, stacked arrangement.

* * * * *